US009161119B2

(12) United States Patent
Powell

(10) Patent No.: US 9,161,119 B2
(45) Date of Patent: Oct. 13, 2015

(54) PHI-BASED ENCLOSURE FOR SPEAKER SYSTEMS

(71) Applicant: Colorado Energy Research Technologies, LLC, Englewood, CO (US)

(72) Inventor: Wayne J. Powell, Centennial, CA (US)

(73) Assignee: Colorado Energy Research Technologies, LLC, Englewood, CO (US)

( * ) Notice: Subject to any disclaimer, the term of this patent is extended or adjusted under 35 U.S.C. 154(b) by 0 days.

(21) Appl. No.: 14/225,233

(22) Filed: Mar. 25, 2014

(65) Prior Publication Data

US 2014/0294219 A1 Oct. 2, 2014

Related U.S. Application Data

(60) Provisional application No. 61/807,235, filed on Apr. 1, 2013.

(51) Int. Cl.

| | |
|---|---|
| ***H04R 1/20*** | (2006.01) |
| ***H04R 1/34*** | (2006.01) |
| ***H04R 1/02*** | (2006.01) |
| ***H04R 1/28*** | (2006.01) |

(52) U.S. Cl.
CPC .. *H04R 1/34* (2013.01); *H04R 1/02* (2013.01); *H04R 1/2853* (2013.01); *H04R 1/2857* (2013.01); *H04R 2201/029* (2013.01)

(58) Field of Classification Search
CPC ..... H04R 1/02; H04R 1/28; H04R 1/2803; H04R 1/2815; H04R 1/2853; H04R 1/2857; H04R 1/30; H04R 1/34; H04R 1/2826; H04R 1/2849; H04R 2201/029
USPC ..... 181/152, 192–193; 381/340–341, 338
See application file for complete search history.

(56) References Cited

U.S. PATENT DOCUMENTS

| | | | | |
|---|---|---|---|---|
| 1,605,854 | A * | 11/1926 | Putt | 181/193 |
| 1,665,699 | A * | 4/1928 | Graef | 181/193 |
| 1,866,921 | A | 7/1932 | Black | |
| 1,888,769 | A | 11/1932 | Muench | |

(Continued)

FOREIGN PATENT DOCUMENTS

| | | |
|---|---|---|
| EP | 1335629 A2 | 8/2003 |
| KR | 101104526 B1 | 1/2012 |

(Continued)

OTHER PUBLICATIONS

Hufker, B., "Fibonacci Numbers, the "Golden Mean," and Audio Engineering", db, Jun. 1979, pp. 41-43.

(Continued)

*Primary Examiner* — Curtis Kuntz
*Assistant Examiner* — Ryan Robinson
(74) *Attorney, Agent, or Firm* — Fish & Tang LLP

(57) ABSTRACT

A speaker system with an enclosure having a spiral pathway is presented. The speaker system includes an electro-acoustic transducer that generates sounds according to an audio input. The speaker system also includes an enclosure having an interior pathway defined by a wall that is curved substantially as a spiral. The speaker system is configured such that the sound generated by the electro-acoustic transducer travels along at least a portion of the curved pathway before leaving the enclosure.

20 Claims, 6 Drawing Sheets

(56) References Cited

U.S. PATENT DOCUMENTS

| | | | | |
|---|---|---|---|---|
| 1,890,719 | A | 12/1932 | Busch | |
| 2,228,024 | A | 1/1941 | Abrahams | |
| 2,801,703 | A | 8/1957 | Martin | |
| 2,871,971 | A | 2/1959 | Beecroft et al. | |
| 3,486,579 | A | 12/1969 | Albarino | |
| 3,666,041 | A * | 5/1972 | Engelhardt | 181/145 |
| 3,750,838 | A | 8/1973 | Pyle, Jr. | |
| 3,776,361 | A | 12/1973 | Rolle | |
| 3,816,672 | A | 6/1974 | Gefvert et al. | |
| 3,884,326 | A | 5/1975 | Orisek | |
| 3,895,188 | A | 7/1975 | Ingraham | |
| 3,908,095 | A | 9/1975 | Jinsenji | |
| 3,917,024 | A | 11/1975 | Kaiser, Jr. | |
| 3,945,461 | A | 3/1976 | Robinson | |
| 3,978,941 | A | 9/1976 | Siebert | |
| 3,982,607 | A | 9/1976 | Evans | |
| 4,157,741 | A | 6/1979 | Goldwater | |
| 4,164,988 | A | 8/1979 | Virva | |
| 4,421,200 | A | 12/1983 | Ferralli et al. | |
| 4,629,030 | A | 12/1986 | Ferralli | |
| 4,635,749 | A | 1/1987 | Tattersall | |
| 4,718,372 | A | 1/1988 | Wheeler | |
| 4,790,408 | A | 12/1988 | Adair | |
| 4,819,761 | A | 4/1989 | Dick | |
| 5,033,456 | A | 7/1991 | Pell et al. | |
| 5,050,436 | A | 9/1991 | Kunii et al. | |
| 5,109,423 | A | 4/1992 | Jacobson et al. | |
| 5,173,575 | A | 12/1992 | Furukawa | |
| 5,199,075 | A | 3/1993 | Fosgate | |
| 5,220,608 | A | 6/1993 | Pfister | |
| 5,268,539 | A | 12/1993 | Ono | |
| 5,525,767 | A | 6/1996 | Fields | |
| 5,532,438 | A | 7/1996 | Brown | |
| 5,637,840 | A | 6/1997 | Kim | |
| 5,751,827 | A * | 5/1998 | Takahashi | 381/190 |
| 5,822,443 | A | 10/1998 | Kim | |
| 5,832,099 | A | 11/1998 | Wiener | |
| 5,933,508 | A | 8/1999 | Fuke et al. | |
| 5,956,411 | A | 9/1999 | Edgar | |
| 6,055,320 | A | 4/2000 | Wiener et al. | |
| 6,363,157 | B1 | 3/2002 | Chick | |
| 6,648,098 | B2 * | 11/2003 | Nichols | 181/193 |
| 6,950,530 | B2 | 9/2005 | Baird et al. | |
| 7,203,329 | B2 | 4/2007 | Alexander et al. | |
| 7,275,621 | B1 | 10/2007 | Delgado, Jr. | |
| 7,284,638 | B1 * | 10/2007 | Sahyoun | 181/156 |
| 7,352,875 | B2 | 4/2008 | Hatano et al. | |
| 7,604,094 | B2 | 10/2009 | Magyari | |
| 7,686,129 | B2 | 3/2010 | Delgado, Jr. | |
| 8,320,597 | B2 * | 11/2012 | Griffin et al. | 381/339 |
| 8,422,721 | B2 | 4/2013 | Rizzello | |
| 8,430,201 | B1 * | 4/2013 | Weidner | 181/199 |
| 8,640,818 | B1 | 2/2014 | Weidner | |
| 2004/0084245 | A1 | 5/2004 | MacKin | |
| 2006/0090955 | A1 | 5/2006 | Cardas | |
| 2012/0163648 | A1 * | 6/2012 | Cardas | 381/380 |

FOREIGN PATENT DOCUMENTS

| | | | |
|---|---|---|---|
| KR | 101194117 | B1 | 10/2012 |
| WO | 2008/107835 | | 9/2008 |
| WO | 2012/089557 | | 7/2012 |

OTHER PUBLICATIONS

ISA/EP, International Search Report and Written Opinion for International Application No. PCT/US2014/031772, dated Jul. 18, 2014; 12 pages.

* cited by examiner

FIG. 3
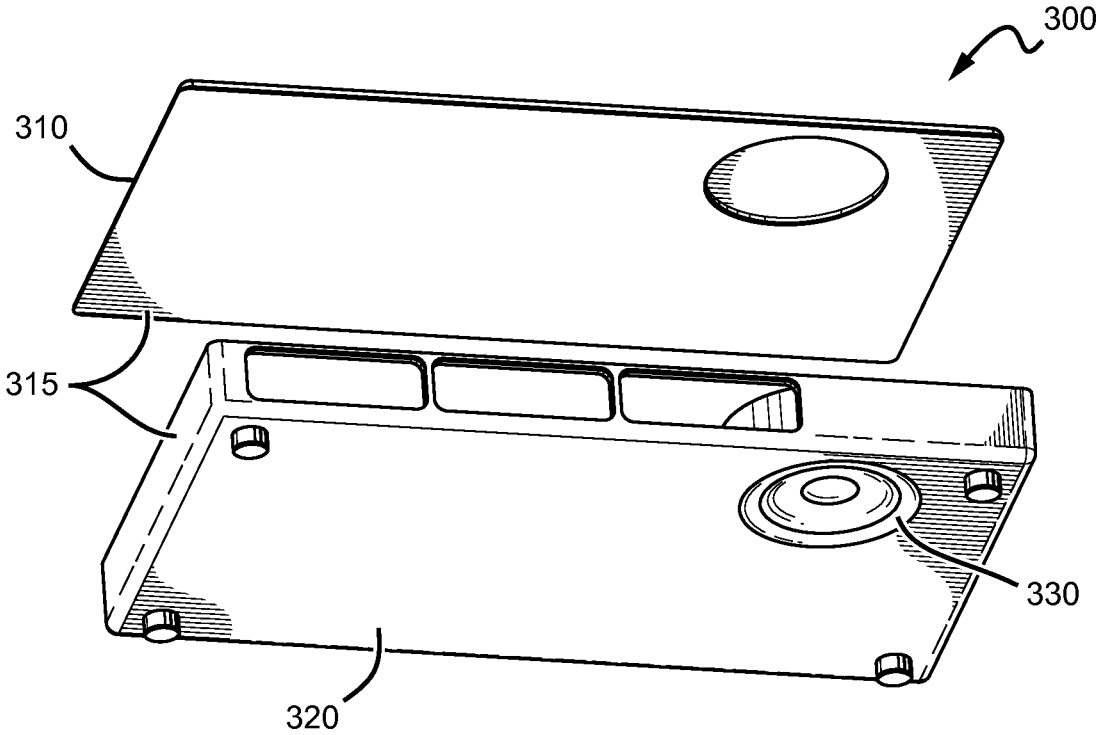
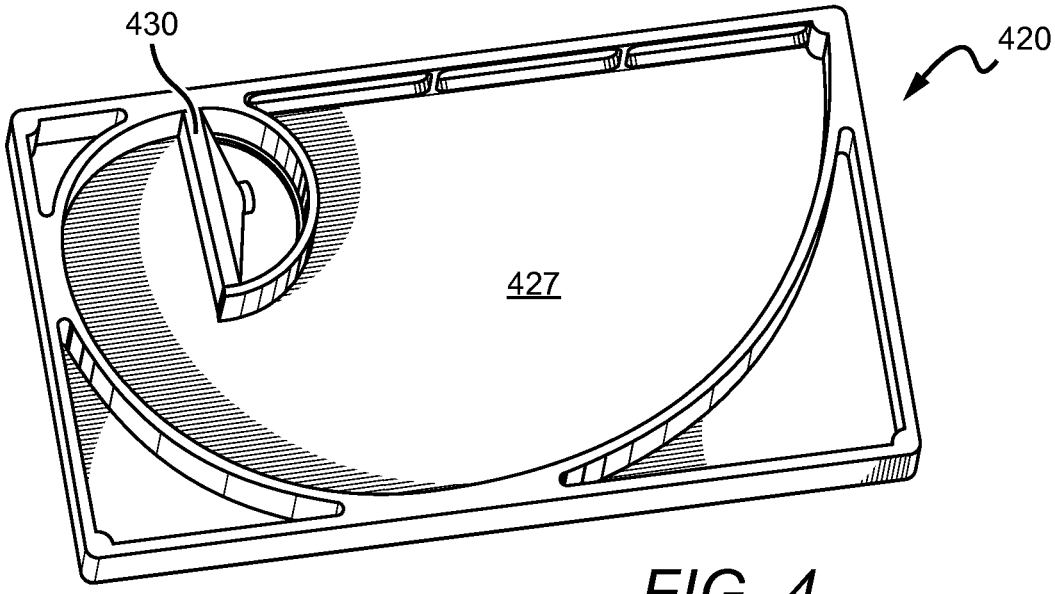
FIG. 4

FIG. 5
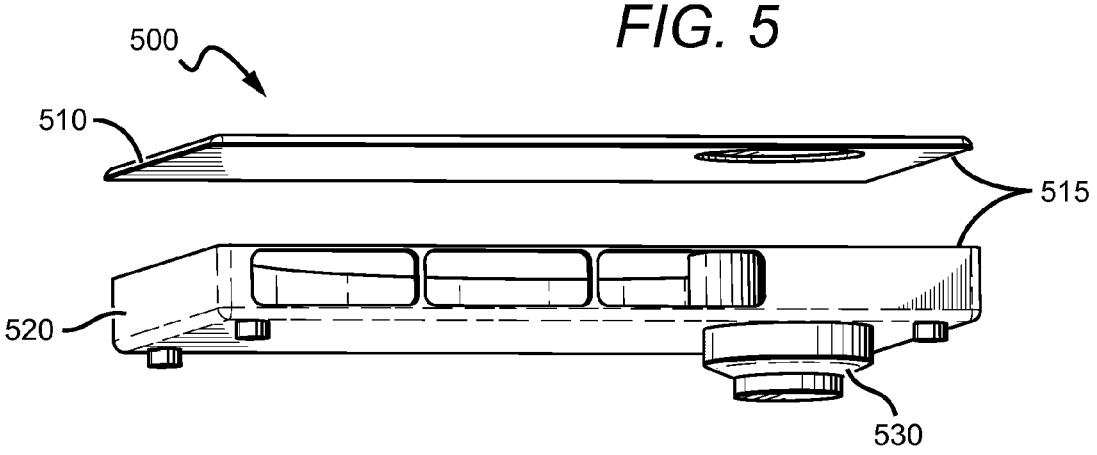
FIG. 6
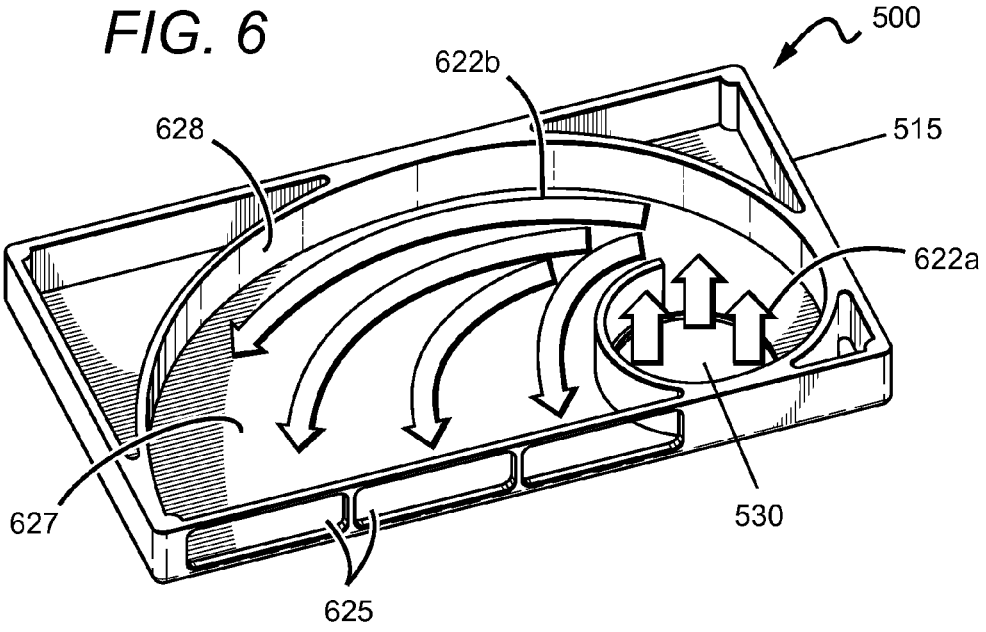
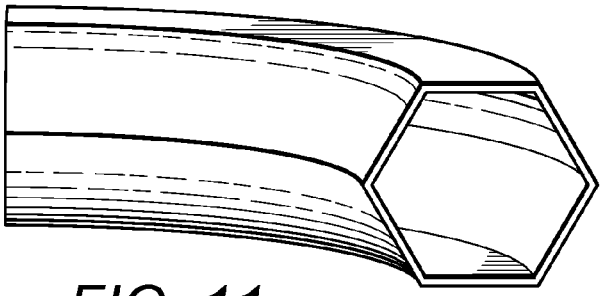
FIG. 11

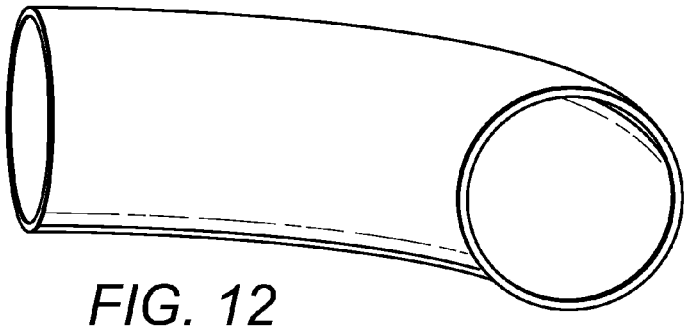
FIG. 12
FIG. 13
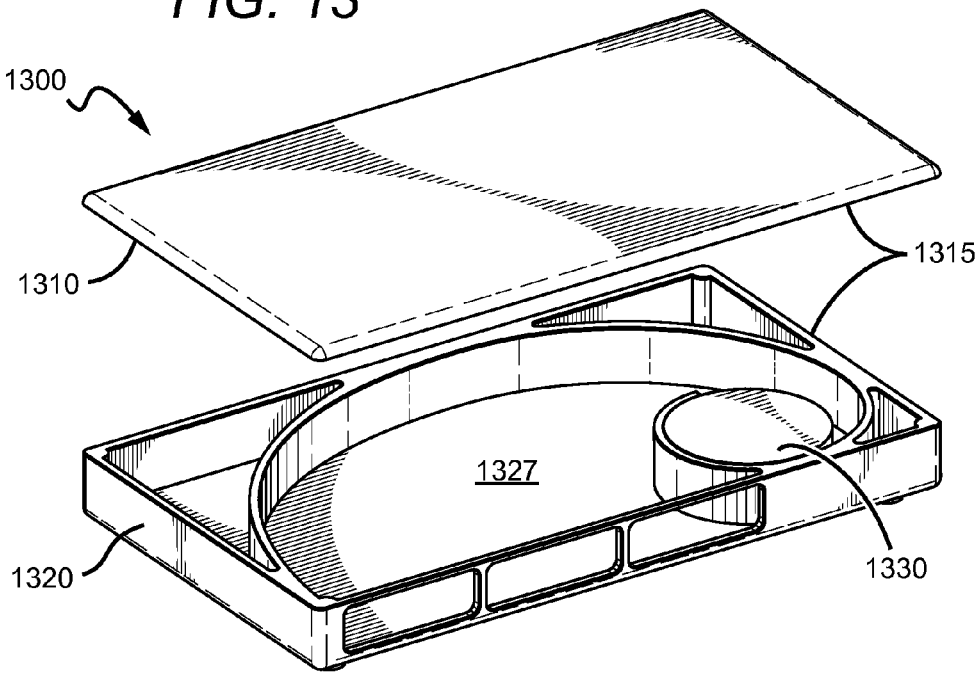
FIG. 14
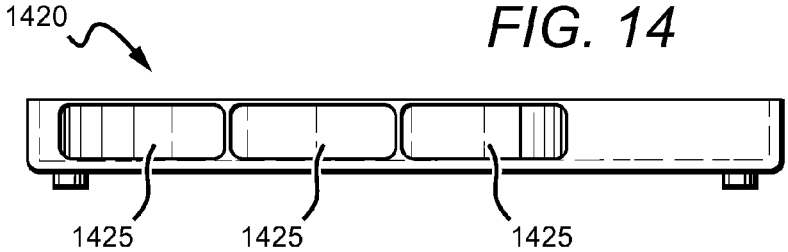

PHI-BASED ENCLOSURE FOR SPEAKER SYSTEMS

This Application claims priority to U.S. Provisional Patent Application No. 61/807,235, filed on Apr. 1, 2013. This and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

FIELD OF THE INVENTION

The field of the invention is speaker systems.

BACKGROUND

The following description includes information that may be useful in understanding the present invention. It is not an admission that any of the information provided herein is prior art or relevant to the presently claimed invention, or that any publication specifically or implicitly referenced is prior art.

A speaker is an electro-acoustic transducer that transforms electrical audio signals into sound. A traditional speaker includes a diaphragm (e.g., cone, dome, membrane, diaphragm, etc) attached to a voice coil, which is suspended in a static magnetic field. An amplifier is electrically coupled to the voice coil and provides current (i.e., signal) to the voice coil producing a magnetic field. This magnetic field interacts with the static magnetic field causing the voice coil and the diaphragm to vibrate producing sound.

The efficiency of a speaker is determined through the analysis of the speaker's conversion of electrical power from the amplifier to the emitted sound power of the speaker. Conventional speakers typically are extremely inefficient at converting electrical energy to sound energy (less than 5% of electrical energy is converted into sound energy by conventional transducers). Efforts have been made to improve speaker system power efficiencies. The efficiency of a speaker can be affected by the enclosure in which it rests. For example, U.S. Pat. No. 7,686,129 to Delgado entitled "Acoustic Horn Having Internally Raised Geometric Shapes," filed Aug. 30, 2007 discloses a speaker that uses a particularly shaped horn to increase the overall efficiency of a speaker driver. However, horn shaped speaker enclosures still cause undesirable destructive interference in the sound waves projected from the driver of the speaker. Because of this behavior, this horn does not perform equally well across the entire range of frequencies that the speaker is capable of delivering.

In addition, U.S. Pat. No. 6,055,320 to Wiener et al. entitled "Directional Horn Speaker System," filed Feb. 26, 1998 discloses a directional speaker. In doing so, it describes several attempts to increase audio quality. For example, an in-line phase plug is mounted in front of the speaker driver for manipulating the wave front of sound waves produced by the speaker driver. However, the invention fails to provide improvements of efficiency relative to sensitivity and clarity. This is mainly due to the fact that as one improves the sensitivity and clarity of a speaker system, the power loss increases, and hence, the overall efficiency of the system is degraded.

U.S. Pat. No. 4,421,200 to Ferralli et al. entitled "Elliptically Shaped Transducer Enclosure," filed Dec. 16, 1981, provides for an enclosure incorporating an acoustically reflective shell. The elliptical shapes share one common focus and each has one distinct focus. Even though this does improve efficiency over prior absorber-type enclosures, there still remain inefficiencies in the shape with respect to output power as compared to input electrical signals.

However, the above-mentioned patents still fail to dramatically improve the power efficiency of speaker systems. Thus, there remains a need to further improve speaker efficiency.

All publications herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

SUMMARY OF THE INVENTION

The inventive subject matter is directed to methods and embodiments for a speaker system having a curved pathway through which sound can travel. The pathway can be curved substantially as a spiral having a speaker in the center of the spiral. Additionally, a speaker can be oriented to project sound into the pathway such that the curved shape of the pathway enhances sound output from the speaker.

In a preferred embodiment, the speaker system has an electro-acoustic transducer placed in an enclosure having a pathway defined by a curved wall that is curved substantially as a spiral. The electro-acoustic transducer is positioned within the pathway such that sound produced by the elector-acoustic transducer travel through the pathway toward the second opening before leaving the enclosure.

The inventors contemplate that the curved wall of some aspects of the inventive subject matter will curve as different types of spirals. Contemplated spiral types include logarithmic spirals, Archimedean spirals, and hyperbolic spirals. Among the logarithmic spirals contemplated is the golden spiral. A golden spiral is defined as having a growth factor equal to the golden ratio (ϕ), meaning a golden spiral gets wider (or further from its origin) by a factor of ϕ for every quarter turn it makes. In mathematic terms, two quantities are in the golden ratio if their ratio is the same as the ratio of their sum to the larger of the two quantities. Further aspects of the inventive subject matter include the implementation of a three-dimensional spiral, which, in a Cartesian coordinate system, would have non-constant values for x, y, and z.

In addition, in some embodiments, the pathway defined by the spiral-curved wall can have different cross-sections. For example, the pathway can have an elliptical cross-section, a circular cross-section, or even just a round cross-section that does not conform to any particular shape. The pathway can also be shaped to have a convex polygonal cross-section, which describes shapes having interior angles less than or equal to 180 degrees (e.g., a triangle, a rectangle, a hexagon, an octagon, etc.). The pathway can be set up to have a first and second opening, where the first opening is preferably smaller than the second opening. The speaker can be placed in the pathway closer to the first opening than to the second opening in such a way that it can project sound into the pathway, and the second opening ideally allows outward projection the sound originating from the speaker.

In some aspects of the inventive subject matter, the enclosure and/or pathway can be made of different materials based on the desired material properties. One possible material property that can be altered through material selection is the attenuation coefficient. The inventors contemplate that in some embodiments the enclosure and/or pathway can be made of a material having a low attenuation coefficient to decrease the amount of energy reflected from the walls of the enclosure and/or pathway, while other embodiments may use materials having a high attenuation coefficient to increase the amount of energy reflected off the walls of the enclosure and/or pathway.

It is further contemplated that at least some portion of the curved wall can deviate radially outward from the mathematically defined spiral path, allowing for flared portions of the curved wall.

Regarding the electro-acoustic transducer, in some aspects of the inventive subject matter it is positioned so that the diaphragm is within the pathway. In other aspects, it is positioned so that the diaphragm is substantially co-planar with an imaginary plane defined by at least three points along the path of the spiral.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWINGS

FIG. 3 shows a preferred embodiment of a speaker enclosure in an exploded isometric view from the bottom having a speaker disposed within the pathway so that it projects sound out of the enclosure.

FIG. 4 shows a preferred embodiment of a speaker enclosure in a cut-away top view with a speaker oriented to project sound directly into the pathway.

FIG. 5 is an exploded side view of a preferred embodiment of a speaker enclosure showing having a speaker attached so that it can project sound into the pathway.

FIG. 6 the general directions of sound waves from the speaker through the pathway of the speaker enclosure of some embodiments.

FIG. 11 shows an embodiment of the pathway having a hexagonal cross-section.

FIG. 12 shows an embodiment of the pathway having a circular cross-section.

FIG. 13 shows a preferred embodiment of the speaker enclosure in an exploded isometric view from the top having a speaker within the enclosure.

FIG. 14 is a side view of a preferred embodiment of the speaker enclosure showing the opening of the enclosure.

DETAILED DESCRIPTION

Figure 1:
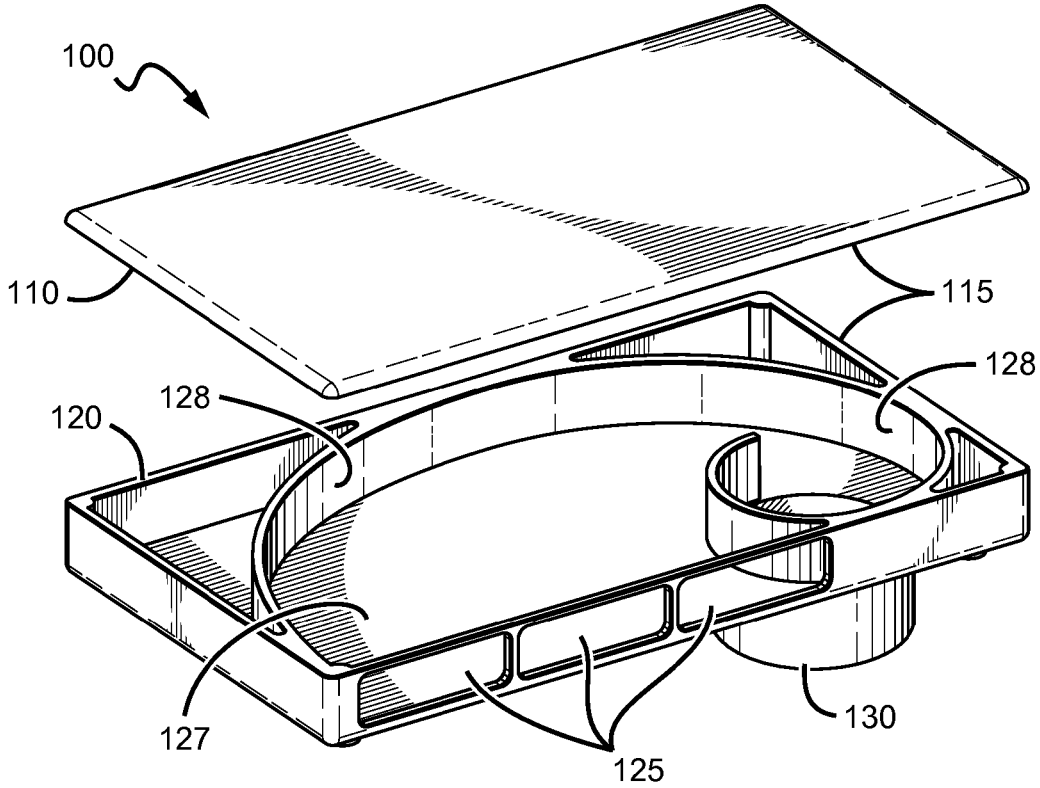
FIG. 1 shows a preferred embodiment of a speaker enclosure in an exploded isometric view from the top having a speaker attached.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

In some aspects of the invention, an enclosure for a speaker system is presented. The speaker system includes an electro-acoustic transducer that generates sounds according to an audio input. The speaker system also includes an enclosure having an interior pathway defined by a wall that is curved substantially as a spiral. The speaker system is configured such that the sound generated by the electro-acoustic transducer travels along at least a portion of the curved pathway before leaving the enclosure.

It has been contemplated that sound quality can be significantly improved when the sound travels through a spiral pathway. One such advantage is that a spiral based horn enables the driver to operate at its full range without modulating the high frequency material thereby providing higher fidelity sound reproduction. This is because spiral horns do not produce a specific or peaky resonant point that interferes with the driver's free air resonance, so as a result rear loaded speakers have a smooth transition across the frequency band of the speaker.

Some other advantages include greater sound amplification efficiency, the elimination of sharp crossing point minimizing distortion, and sound reproduction that is analogous to the original sound due to absence of compressive or pressure reflex anomalies.

Sound pathways can be constructed in many different configurations, but one particularly useful sound pathway is a horn. A horn shaped sound pathway is one where the walls of the pathway continually expand away from the sound source. Use of a horn design significantly improves the quality of the sound leaving the pathway. Horn sound pathways can further be shaped into a spiral. As defined herein, a spiral is a curve that emanates from a central point, and progressively moving away from the central point as it revolves around the central point. It is noted that not every section on the curve has to move away from the central point as long as the curve as a whole substantially does (e.g., about 80% of the curve moves away from the central point).

In particular, sound propagating through horn-like pathways formed into a spiral experience constructive interference in the pathway. On the other hand, virtually all unwanted interference is avoided. This design can be implemented in many devices and in many configurations. For example, consumer devices are often size-limited, which can affect the ability of sound producing devices to produce high quality audio. Implementing a spiral based enclosure in products such as notebooks, portable self-powered speakers, monitors, and sound bars can greatly improve audio quality.

Standard horns, which are made from linearly diverging surfaces, cause destructive interference in the sound waves projected therein. This is a result of standard horn geometry causing sound waves to reflect back onto themselves. A spiral based horn used to project sound, however, reduces or prevents sound waves from reflecting back onto themselves, which would create standing waves and/or destructive interference. Because the surfaces of the spiral based horn reflect sound waves differently at each point along the curved surface, the bandpass behavior normally associated with horns based on typical dimensionality is avoided.

FIG. 1 illustrates an example of such a speaker system 100. The speaker system 100 includes an electro-acoustic transducer 130 and an enclosure 115. The electro-acoustic transducer 130 of the speaker system 100 in some embodiments can comprise a number of different devices that make use of a diaphragm to produce sound. For example, loudspeakers (or "speakers"), reproduce sound by vibrating a diaphragm that is attached to a voice coil to generate compression waves. When alternating current (i.e., electrical audio signal input) is passed through a voice coil surrounding a magnet (or a voice coil that is surrounded by a permanent magnet), the coil is forced back and forth as a result of Faraday's law, causing the attached diaphragm to respond with a back-and-forth motion that creates compression waves (i.e., sound). Where high fidelity reproduction of sound is required, multiple loudspeakers may be used, each reproducing a different part of the audible frequency range.

The electro-acoustic transducer can be configured and oriented in numerous ways. For example, the size and shape of the diaphragm may be altered. The inventors contemplate that the diaphragm can be shaped as a circle, an ellipse, a rectangle, or even an irregular shape designed as needed for a particular embodiment.

It is contemplated that the electro-acoustic transducer can be configured as a speaker capable of reproducing different frequency ranges. Some speaker types contemplated include low-, mid-, and high-range speakers. A low-range speaker (e.g., a subwoofer) is typically capable of reproducing sounds in the range of 20 Hz to 2 kHz. A mid-range speaker is typically capable of reproducing frequencies in the range of 300 Hz to 5 kHz. Finally, a high-range speaker is typically capable of reproducing frequencies ranging from 2 to 20 kHz.

In addition to the contemplated use of different transducer diaphragm sizes and shapes, and the use of speakers providing different frequency reproduction capabilities, the inventors further contemplate that some embodiments of the inventive subject matter can include compound speakers. A compound speaker is one that includes multiple electro-acoustic transducers. These transducers can be designed to reproduce different frequency ranges to create richer sounds. The inventors contemplate the use of at least two, three, and four transducers per compound speaker using speakers capable of either the same or different frequency reproduction. Some embodiments might have, for example, low-, mid-, and high-range speakers all together, while others might include two mid-range speakers or two low-range speakers.

The diaphragm of an electro-acoustic transducer can be made from a number of different materials. In some embodiments, it can be made from synthetic materials, while in others it can be made from natural materials. A synthetic material diaphragm can be made from multiple types of synthetic materials including plastics, whereas a natural material diaphragm can be made from materials including organic and inorganic natural materials.

As mentioned above, the speaker system 100 also includes an enclosure 115 comprising a sound pathway 127 for sound (produced by the transducer as described above) to travel through before leaving the enclosure 115. Different embodiments implement the spiral pathway in different ways. Under one approach, a spiral pathway can be defined by a curved wall that is shaped as a spiral. FIG. 1 illustrates a sound pathway 127 that is constructed under this approach. Specifically, the enclosure 115 as shown in FIG. 1 includes two halves—a first enclosure half 110 and a second enclosure half 120. The first half 110 and the second half 120, when mated (either permanently or non-permanently), create a pathway 127 configured to allow sound to travel through it before exiting the enclosure. In some embodiments, the first enclosure half 110 and the second enclosure half 120 are two separate components removably or semi-permanently coupled together. In other embodiments, enclosure half 110 and enclosure half 120 can be one integral component. It is contemplated that the first enclosure half 110 can be formed to have half of the curved wall 128 and the second half 120 can have the other half of the curved wall 128, such that when mated, the pathway 127 is formed. As shown, the pathway 127 is shaped substantially as a spiral defined by the curved wall 128. It is noted that the curved wall 128 does not have to extend all the way to the central point of the spiral. As shown in FIG. 1, the curved wall 128 begins at a point of the spiral that allows the placement of the transducer 130 in the enclosure 115.

In this example, the transducer 130 is oriented such that the diaphragm of the transducer is substantially perpendicular to the cross-section of the pathway 127 (e.g., within 5 degrees of an invisible plane that is perpendicular to the cross-section of the pathway 127).

The enclosure 115 can be made from different materials and in different configurations depending on the desired acoustic qualities. One way to quantify the acoustic properties of a material is to measure the attenuation coefficient. The attenuation coefficient is a ratio of the amount of energy reflected from a surface to the amount of energy incident to that surface. Thus, a material having an attenuation coefficient of 1 would reflect all incident sound energy, whereas a material having an attenuation coefficient of 0 would absorb all incident sound energy. It is contemplated the enclosure can be made from materials having attenuation coefficients tuned to absorb or reflect a desired amount of sound energy (e.g., a material with an attenuation coefficient that would result in muting thereby producing a desired sound output from the second opening, or a material that reflects as much sound as possible to ensure minimal loss of fidelity).

Figure 2:
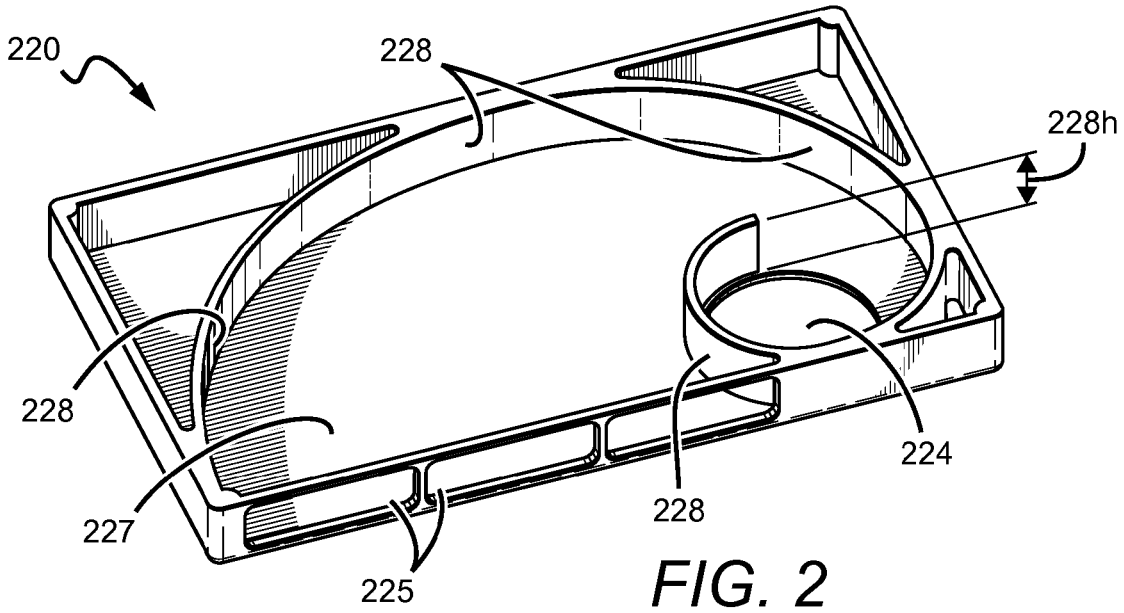
FIG. 2 shows half of a speaker enclosure of some embodiments.

In FIG. 2, an embodiment of the speaker system 220 is shown having a curved wall 228 curved as a logarithmic spiral (more details about curved walls curved in different types of spiral will be further defined further below by reference to FIGS. 7-10). The logarithmic spiral provides the cross-section of the pathway 227 to progressively expand (i.e., getting larger) as the pathway 227 gets further away from the origin (central point) of the spiral. In this example, the speaker system 220 has a first opening 224 and a second opening 225. An electro-acoustic transducer's diaphragm in this embodiment would be placed near the smallest radius of curvature of curved wall 228 (i.e., near or at the central point of the spiral).

In addition to the position, the electro-acoustic transducer can be oriented differently with respect to the pathway 227 and/or the curved wall 228. For example, the electro-acoustic transducer can be oriented such that the direction of vibration of its diaphragm (i.e., cone, dome, membrane, etc.) would be substantially parallel (co-planar) to the height of curved wall **228*h* (e.g., within 5 degrees of an invisible plane that is parallel to the height of the curved wall 228*h*), as illustrated by the transducer 430 in FIG. 4. In other words, the transducer is oriented so that the diaphragm is substantially parallel (co-planar) to the cross-section of the pathway 227 (e.g., within 5 degrees of an invisible plane that is parallel to the cross-section of the pathway 227). As such, an electro-acoustic transducer in this embodiment would produce compression waves travelling generally parallel to the height (the cross-section) of curved wall 228*h***.

Radius of curvature refers to the radius of a hypothetical circle that would be formed by continuing the curvature at a point on a curved line. In the case of a spiral, each point on moving along the spiral path away from the center (the central point of the spiral) has a larger radius of curvature than all previous points along that path. In some aspects of the invention, the second opening/openings 225 of the enclosure are covered by some material (e.g., a mesh that does not substantially obstruct sound energy from escaping from the enclosure). The inventors additionally contemplate the second opening 225 can be made up of one or more openings.

The speaker can be positioned and oriented in relation to the enclosure in a number of different ways. For example, FIG. 3 shows an embodiment of the speaker system 320 where the electro-acoustic transducer 330 is positioned such that it projects sound primarily away from the enclosure. The enclosure 315 of this embodiment 300 is defined by a first enclosure half 310 and a second enclosure half 320. The first enclosure half 310 and the second enclosure half 320 can be two separate components removably or semi-permanently coupled together. In other embodiments, enclosure half 310 and enclosure half 320 can be one integral component.

In this embodiment, the enclosure 315 is used to vent the back side of the electro-acoustic transducer 330. In such an embodiment, the spiral based horn shape broadens range of frequencies associated with free air resonance of the electro-acoustic transducer 330. In non-spiral based enclosures, standing waves are typically generated in such an enclosure. This leads to decreased performance of the electro-acoustic transducer 330 and less efficient use of power.

Preferably, the electro-acoustic transducer 330 is oriented to project sound directly into the pathway. For example, FIG. 4 shows an embodiment of the second enclosure half 420 wherein the electro-acoustic transducer 430 is positioned and oriented with respect to the enclosure such that sound projects directly into the pathway 427.

FIG. 5 shows an embodiment of the speaker system 500 in which the electro-acoustic transducer 530 is positioned and oriented so that it projects primarily into the spiral pathway of the enclosure 515. In this example, the position and orientation of the transducer 530 is identical to the position and orientation of the transducer 130 of FIG. 1. FIG. 6 shows how sound is generally projected from transducer 530 through spiral pathway 627 within enclosure 515. For clarity, the first half 510 of enclosure 515 is not shown to not obstruct the view of the pathway 627. Arrows **622*a* and 622*b* in FIG. 6 illustrate the general directions of sound that is projected from transducer 530 through pathway 627. The sound from transducer 530 first travels through the height of the pathway 627, as shown by arrows 622*a*. Then, the sound moves along the pathway 627, as shown by arrows 622*b*. As mentioned above, the arrows 622*a* and 622*b* only illustrate the general directions of the sound. It is envisioned that sound waves travel in multiple directions—some will bounce off the curved wall 628 of the pathway 627 while some will bounce off the enclosure casing 515 within the pathway 627. However, it is envisioned that the curved wall 628 and the enclosure 515 within the pathway 627 are designed to generally redirect the sound wave according to arrows 622*a* and 622*b* and out of the enclosure 515 via the second opening/openings 625**.

It should be noted that (i) the diaphragm of an electro-acoustic transducer produces compression waves in many different directions and (ii) redirecting compression waves can produce many different wave directions, and even turbulent flow. Although a diaphragm produces sound in many different directions, the primary direction is considered to be a direction substantially normal to the diaphragm. As such, arrows **622*a* and arrows 622*b* merely represent the general direction and/or flow of sound within pathway 627**.

It is contemplated that the curved wall that defines the sound spiral pathway within the enclosure can follow different types of spirals to create different types of sound spiral pathways. In some embodiments, the curved wall of the speaker enclosure can be curved substantially according to a mathematically defined spiral. It is contemplated that different sound pathways curved according to different types of spirals can have different effects on sound quality. Contemplated spiral types include logarithmic spirals, Archimedean spirals, and hyperbolic spirals.

Figure 7:
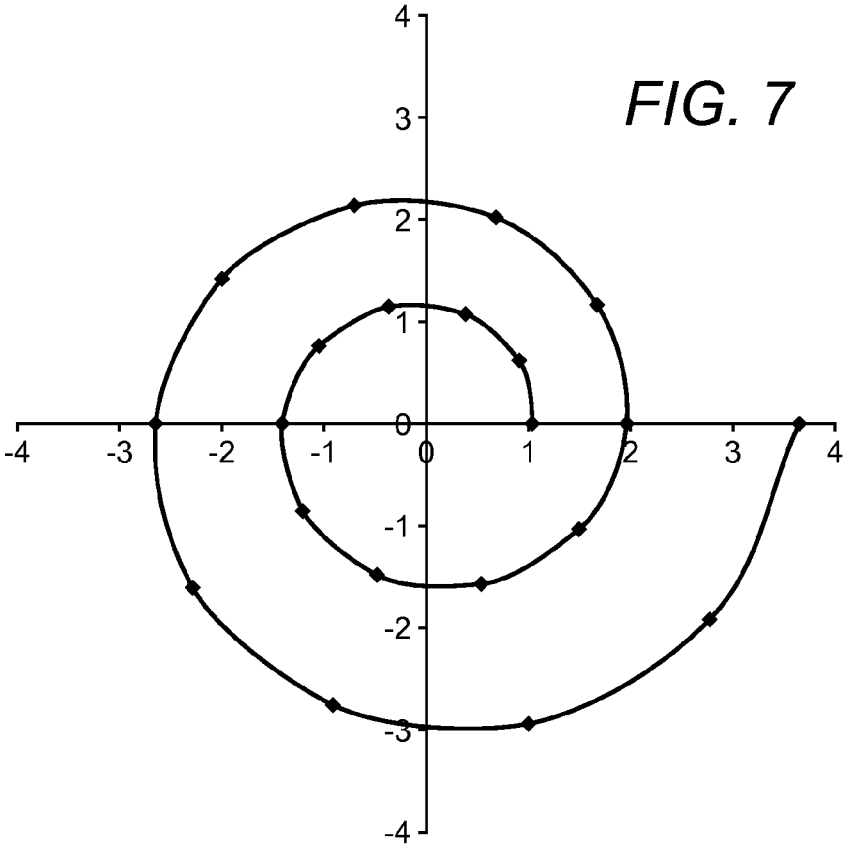
FIG. 7 shows a logarithmic spiral with a curve fit.

Logarithmic spirals are defined by the equation:

$$r=ae^{b\theta}$$

where a and b are arbitrary constants, and r and θ are cylindrical coordinates. FIG. 7 shows an example of a logarithmic spiral where θ ranges from 0 to 4π, a is set to 1, b is set to 0.1, and r is a radius from the center. This equation is expressed in polar coordinates (r, θ), so to create the plot the coordinates were converted to Cartesian coordinates (x, y). The line connecting each spiral point is a best fit line, not an exact fit.

Among the logarithmic spirals contemplated is the golden spiral. A golden spiral is defined as having a growth factor equal to the golden ratio (ϕ), where the golden ratio (ϕ) can be expressed as $$\frac{1+\sqrt{5}}{2}.$$

In other words, a golden spiral gets wider (or further from its origin) by a factor of ϕ for every quarter turn it makes. In mathematic terms, two quantities are in the golden ratio if their ratio is the same as the ratio of their sum to the larger of the two quantities.

Figure 8:
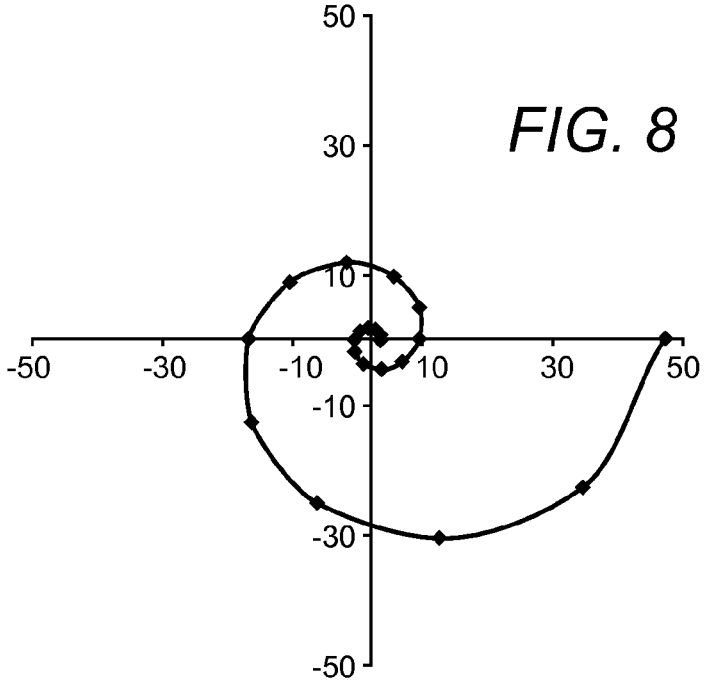
FIG. 8 shows a golden spiral with a curve fit.

The defining equation of a golden spiral is the same as for that of a logarithmic spiral, except b is defined as, $$b = \frac{\ln(\varphi)}{\theta_{right}}$$

where $\theta_{right}$ is $\pi/2$ delineating a right angle. FIG. 8 is an example of a golden spiral where θ ranges from 0 to 4π and a is set to 1. This equation is expressed in polar coordinates (r, θ), so to create the plot the coordinates were converted to Cartesian coordinates (x, y). The line connecting each spiral point is a best fit line, not an exact fit.

Figure 9:
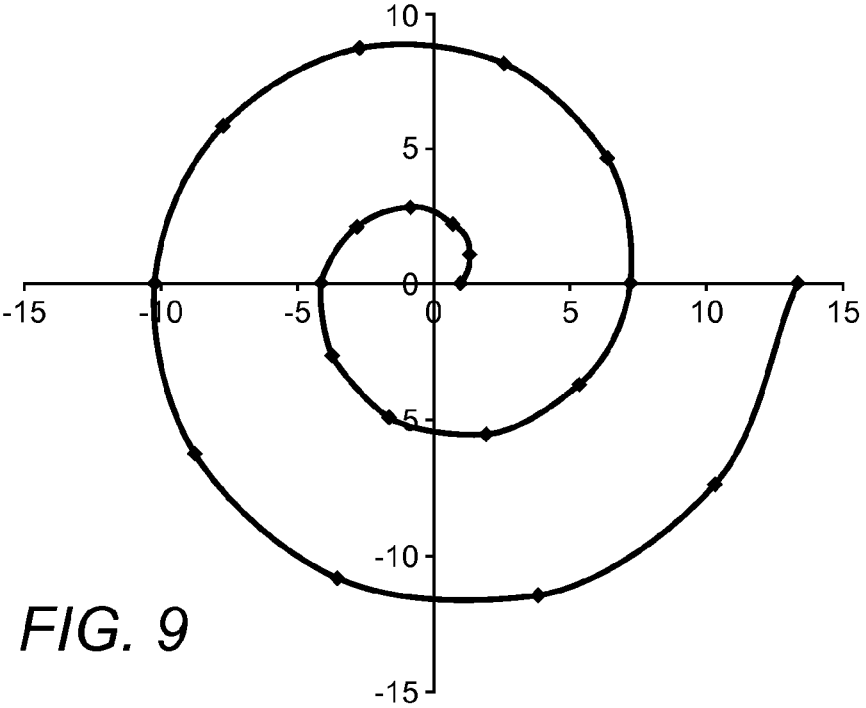
FIG. 9 shows an Archimedean spiral with a curve fit.

Archimedean spirals are defined by the fact that the path of the spiral moves away from the center at a constant rate. Archimedean spirals are defined generally by the equation, $$r=a+b\theta$$

where r is radius. FIG. 9 shows an example of an Archimedean spiral in which a is set to 1, b is set to 1, and θ ranges from 0 to 4π. This equation is expressed in polar coordinates (r, θ), so to create the plot, coordinates were converted to Cartesian coordinates (x, y). The line connecting each spiral point is a best fit line, not an exact fit.

Figure 10:
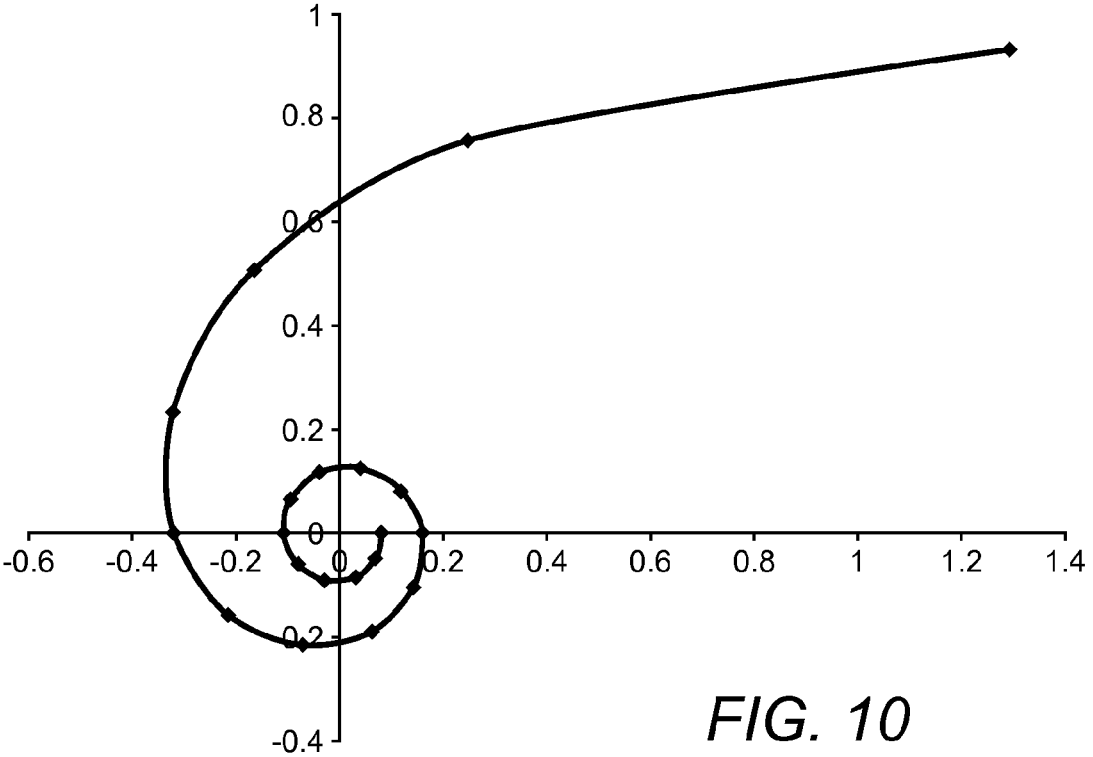
FIG. 10 shows a hyperbolic spiral with a curve fit.

Hyperbolic spirals are defined by the equation, $$r = \frac{a}{\theta}$$

where r is radius. FIG. 10 shows an example of a hyperbolic spiral where a is set to 1, and θ ranges from 0 to 4π. This equation is expressed in polar coordinates (r, θ), so to create the plot the coordinates were converted to Cartesian coordinates (x, y). The line connecting each spiral point is a best fit line, not an exact fit.

Curved walls, according to the inventive subject matter, must curve "substantially" as an ideal spiral path (e.g., one of the spiral paths mathematically defined above). "Substantially" in this case means that each point along the curved wall corresponding to a particular angle, θ, rests within 15% of the magnitude of the radius, r, of the ideal spiral path.

It is noted that the curved wall only needs to substantially follow can follow any one of the spirals described above (including the mathematically defined spirals), but does not need to exactly follow the defined spiral paths. As defined herein, a curved wall substantially follows a pre-defined spiral when each point along the curved wall corresponding to a particular angle, θ, rests within 15% of the magnitude of the radius, r, of the ideal spiral path.

It is also contemplated that the curved wall may have regular deviations to both sides of the spiral path, creating a sinusoidal pattern. Additionally, this allows the pathway to get wider at, for example, the second opening/openings, thereby creating a flared horn shape. In some embodiments, the curved wall can deviate from the spiral path up to 20% of the distance from the spiral path to a line dividing the pathway in half.

The pathway, as mentioned above, is defined by the spiral-curved wall. In addition to following curved walls that follow different types of spirals, it can have different cross-sections. For example, the pathway can have an elliptical cross-section, a circular cross-section, or even just a round cross-section that does not conform to any particular shape. For example, FIG. 11 shows a possible pathway configuration where the pathway has a circular cross-section. In such embodiments, the pathway is still largely defined by the curve of a spiral. The inventors further contemplate the pathway can be configured to take on other rounded shapes such as an ellipse a square with rounded corners, or an irregular rounded shape (e.g., a lima bean shape).

The pathway can also be shaped to have a convex polygonal cross-section. Convex polygonal shapes have interior angles less than or equal to 180 degrees (e.g., a triangle, a rectangle, a hexagon, an octagon, etc.).The curved wall of these embodiments still largely follows a spiral path to define the pathway within the enclosure. FIG. 12 shows an example of a pathway having a hexagonal cross-section. The inventors additionally contemplate that enclosures having a concave interior surface may provide advantages over convex cross-sections.

The inventors further contemplate that the spiral defining the curved wall can be three-dimensional. In a Cartesian coordinate system, a three-dimensional spiral would not have constant values for x, y, or z (or, in cylindrical coordinates, r, θ, z). This allows for the creation of many unique pathway configurations.

FIG. 13 shows an exploded top perspective view of another embodiment of the speaker system 1300 made up of an enclosure 1315 with an internal space having a curved wall 1327 defined by a spiral. The electro-acoustic transducer 1335 of the speaker system 1300 in this embodiment is oriented to project sound out of the enclosure.

FIG. 14 is a side view of yet another embodiment showing the bottom side of a second enclosure half 1420 and the second opening/openings 1425. In alternative embodiments, the second opening/openings 1425 can be made up of one large opening rather than multiple separate openings. The inventors further contemplate that the opening/openings can be covered by a material that does not substantially impair propagation of sound originating in the enclosure.

Microphones contemplated for use with the inventive subject matter operate on similar principles to traditional speakers. A diaphragm is used to sense compression waves (i.e., sound), which in turn vibrates a voice coil that either surrounds or surrounded by a permanent magnet. When the coil moves relative to the magnet, electromagnetic induction occurs generating current in the wire of the voice coil. The electrical signal from the voice coil thus represents the vibrations sensed by the diaphragm of the microphone.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A speaker system, comprising:

an electro-acoustic transducer having a diaphragm; and an enclosure comprising a pathway defined by a curved wall that is curved substantially as a golden spiral, wherein the curved wall deviates sinusoidally from the golden spiral, wherein the pathway has a first opening and a second opening, wherein the first opening is smaller than the second opening, wherein the electro-acoustic transducer is positioned within the pathway closer to the first opening than the second opening such that sound produced by the electro-acoustic transducer travels through the pathway before leaving the enclosure via the second opening.

2. The speaker system of claim 1, wherein a cross-section of the pathway expands as the pathway is further away from the first opening.

3. The speaker system of claim 1, wherein the pathway has a round cross-section.

4. The speaker system of claim 1, wherein the pathway has a convex polygonal cross-section.

5. The speaker system of claim 1, wherein the enclosure comprises a material having an attenuation coefficient below 0.33.

6. The speaker system of claim 1, wherein the enclosure comprises a material having an attenuation coefficient greater than 0.66.

7. The speaker system of claim 1, wherein a portion of the curved wall deviates radially outward from the spiral.

8. The speaker system of claim 1, wherein the electro-acoustic transducer is positioned so that the diaphragm is positioned within the pathway.

9. The speaker system of claim 1, wherein the electro-acoustic transducer is positioned so that the diaphragm is substantially perpendicular to a cross-section of the pathway.

10. The speaker system of claim 1, wherein the electro-acoustic transducer is positioned so that the diaphragm is substantially co-planar with a cross-section of the pathway.

11. A speaker system, comprising:

an electro-acoustic transducer having a diaphragm; and an enclosure comprising a pathway that is curved substantially as a golden spiral, wherein the curved wall deviates sinusoidally from the golden spiral, wherein the pathway has a first opening and a second opening, wherein the first opening is smaller than the second opening, wherein the electro-acoustic transducer is positioned within the pathway closer to the first opening than the second opening such that sound produced by the electro-acoustic transducer travels through the pathway before leaving the enclosure via the second opening.

12. The speaker system of claim 11, wherein the pathway has a round cross-section.

13. The speaker system of claim 11, wherein the pathway has a convex polygonal cross-section.

14. The speaker system of claim 11, wherein a portion of the curved pathway deviates radially outward from the golden spiral.

15. The speaker system of claim 14, wherein the portion is near the second opening.

16. The speaker system of claim 11, wherein the enclosure comprises a material having an attenuation coefficient below 0.33.

17. The speaker system of claim 11, wherein the enclosure comprises a material having an attenuation coefficient greater than 0.66.

18. The speaker system of claim 11, wherein the electro-acoustic transducer is positioned so that the diaphragm is positioned within the pathway.

19. The speaker system of claim 11, wherein the electro-acoustic transducer is positioned so that the diaphragm is substantially co-planar with a cross-section of the pathway.

20. The speaker system of claim 11, wherein the electro-acoustic transducer is positioned so that the diaphragm is substantially perpendicular to a cross-section of the pathway.

* * * * *